US005158299A

United States Patent [19]

Otter

[11] Patent Number: 5,158,299

[45] Date of Patent: Oct. 27, 1992

[54] BALL STRIKING CLUB TRAINING AND EXERCISING DEVICE

[76] Inventor: Milton R. Otter, 104 Hornchurch Crescent, Markham, Ontario L3R 7C8, Canada

[21] Appl. No.: 723,373

[22] Filed: Jun. 28, 1991

[51] Int. Cl.[5] ..... A63B 69/36; A63B 21/08; A63B 21/16; A63B 15/00

[52] U.S. Cl. ..... 273/186.2; 273/191 B; 273/193 A; 273/194 B; 482/109; 482/129

[58] Field of Search ..... 273/191 B, 186 A, 186 C, 273/193 A, 183 D, 191 R, 191 A, 192, 194 B; 272/118, 132

[56] References Cited

U.S. PATENT DOCUMENTS

| | | | |
|---|---|---|---|
| 1,137,349 | 4/1915 | Patterson | 273/191 B X |
| 3,966,203 | 6/1976 | Bickford | 273/191 B X |
| 4,034,991 | 7/1977 | Oppenheimer | 273/186 A |
| 4.181,310 | 1/1980 | Boehmer | 273/191 B X |
| 4,229,002 | 10/1980 | Masters | 273/191 B X |
| 4,353,556 | 10/1982 | Self et al. | 273/191 B X |
| 4,765,615 | 8/1988 | Case | 272/132 |
| 4,953,855 | 9/1990 | Shields | 272/118 |

*Primary Examiner*—George J. Marlo
*Attorney, Agent, or Firm*—Fetherstonhaugh & Co.

[57] ABSTRACT

An apparatus for developing strength and skill in striking a ball in sports such as golf, tennis, squash, racquetball, table tennis, baseball, cricket and the like where an increase of strength, hand-eye coordination, muscle memory and/or concentration is advantageous to the participant. The apparatus provides at least two strings which pass through, or on, a system of anchor members or brackets, such as pulleys, slides, orifices or arcuate shapes, and a means of providing a resisting force, such as a set of weights, or a spring loaded devices. The distal end from the handle of the club, racket or other ball striking device is attached to the strings and the ball striking device is held and swung by the user. The tether strings run though the brackets in such a manner that the forces applied to the ball striking device have both vertical and horizontal components of force throughout the swing which gives beneficial exercise, muscle memory and coordination, and ability to concentrate and focus when the ball striking device is moved slowly through the swing motion.

8 Claims, 5 Drawing Sheets

BALL STRIKING CLUB TRAINING AND EXERCISING DEVICE

BACKGROUND OF THE INVENTION

The present invention relates to exercise apparatus for improving a user's swing with a ball striking device and more specifically to a device that provides components of force to a ball striking device throughout a training swing by a user which gives beneficial exercise, muscle memory and co-ordination and training and concentration and focus when the ball striking device moves slowly through a swing motion.

Devices have been provided in the past for improving a practice swing of a golf club, baseball bat, or the like, and generally these have been restricted to either improving the path of a swing or a particular portion of the swing.

In U.S. Pat. No. 4,229,002 there is provided a golf swing exercise device which may be utilized indoors. It provides a T-shaped support beam. A golf grip and part of a golf club shaft is securely attached to one end of a rope and a weight is attached to the opposite end of the rope. The rope passes through pulleys secured to the support beam. The user exercises by grasping the golf grip and simulating a golf swing which reciprocates the weight attached to the rope. Since there is only one rope involved, the nature of the forces applied to the simulated golf club are restricted.

In U.S. Pat. No. 3,966,203 there is provided a golf swing practice and exercise device in which a free fall weight moves vertically along an open-ended guide tube. A cord is attached at one of the weight and passes through a guide eye at the top of the tube and through a second guide farther down the tube and terminates in a sock which can be attached to the head of a golf club. The cord applies a restraining pull to the golf club head to vary the degree of exercise obtained in use. Again the device is restricted to a single cord and is limited in the nature of the forces which can be applied.

U.S. Pat. No. 4,181,310 shows an apparatus for analyzing the movement of a golf swing. A first line is provided between a measuring device and the golf club head and a second line between a measuring device and the player's body. The purpose of the device is one of analyzing rather than exercising and the fact that only one line is provided to the golf club head imposes limitations.

U.S. Pat. No. 4,034,991 shows a device for use in manipulating a golf club swing. A weighted member such as a slider is secured to another member for guiding the slider through a predetermined path. A pair of flexible cords are secured to a pair of spaced apart posts and engage both the slider and the golf club head. As the user swings the golf club the slider is caused to follow a predetermined path causing the flexible cords to become taut, or slack, at predetermined points through the swing. In this fashion the golf head is caused to be swung to accelerate at maximum speed through the point of contact with the ball. Although two flexible cords are provided in this configuration, they function in a fashion such that they tend to control the action of the swing without providing much in the way of muscle tone improving features, and without providing resistance as the swing moves the golf head through the ball impact zone.

SUMMARY OF THE INVENTION

According to the present invention there is provided an exercise apparatus for improving a user's swing with a ball striking device, comprising: first and second anchor member mountable one higher than the other in spaced relation; a first elongate flexible connector member attachable at a first end thereof to a distal end of said ball striking device, said first elongate connector member coupled directly to said first anchor member and movable with respect thereto and a second elongate flexible connector member attachable at a first end thereof to said distal end, said second elongate connector members coupled directly to said second anchor member and movable with respect thereto, the first and second connector members including bias means for biasing said fist ends of said connectors members towards said respective anchor members thereby; applying, in use, predetermined restraining forces on the striking device whilst it is moved in an arcuate path by the user.

The bias may be provided to the connector members by means of a spring means of predetermined strength and the spring means may, conveniently, be coil springs.

According to another feature of the device the anchor members may be provided with fairlead means which entrain the tether strings and the biasing means may comprise weights connected to the strings at a point remote from their point of connection with the ball striking device.

According to a preferred embodiment a third fairlead means may be located immediately adjacent the higher of the first and second anchor members and entrain a connector member previously entrained on the lower of the fairlead means. The third anchor members may conveniently be formed integrally with its adjacent anchor member and the weight connected to the connector members entrained on the third fairlead may, for some purposes, be a weight of less magnitude than the weight connected to the connector members which is not entrained over the lower anchor member.

BRIEF DESCRIPTION OF THE DRAWINGS

The following is a description by way of example of certain embodiments of the present invention reference being had to the accompanying drawings in which:

FIGS. 1, 2 and 3 illustrate, pictorially, the use of an embodiment of the invention, FIG. 1 showing a user with a golf club at the beginning portion of the swing, FIG. 2 showing the same golf club at a point where it is about to pass through the ball, and FIG. 3 showing the swing at the end of the follow through;

DESCRIPTION OF PREFERRED EMBODIMENT

Turning now to the drawings, it is to be understood that while the illustrated embodiments concern the application of the device to a golf club, the device is equally applicable to a tennis racquet, a baseball bat, a table tennis bat, a raquetball racquet and the like.

Figure 1:
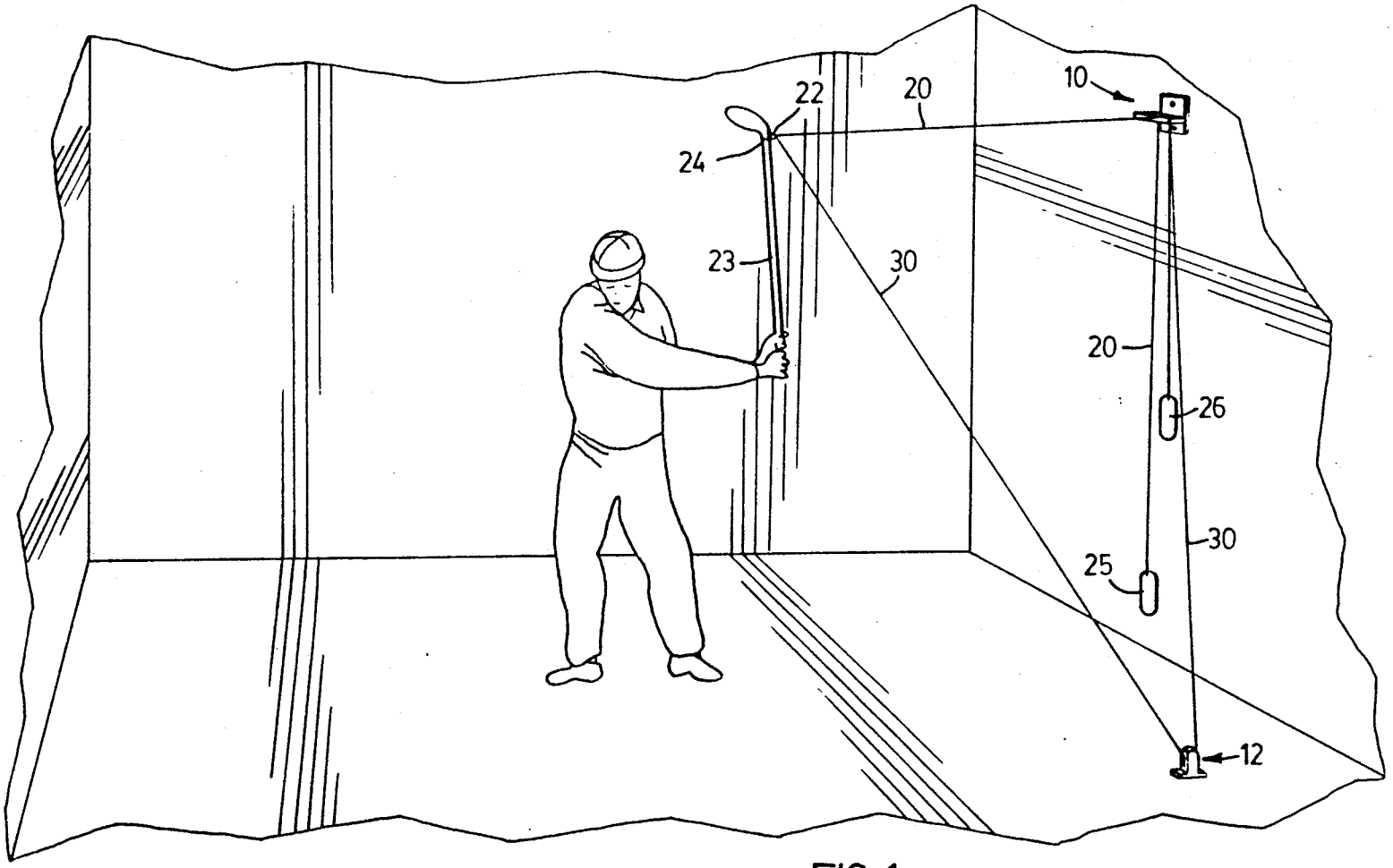
Figure 5:
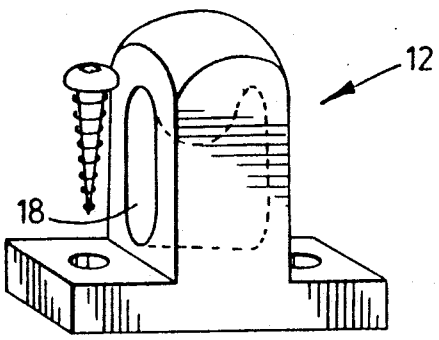
FIG. 5 is a perspective view of a second anchor bracket.
Figure 8:
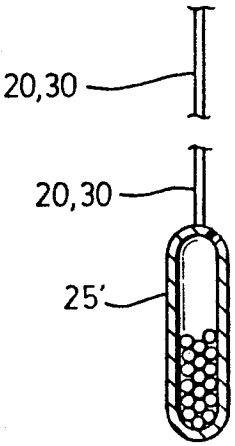
FIG. 8 illustrates a hollow weight filled with shot.
Figure 7:
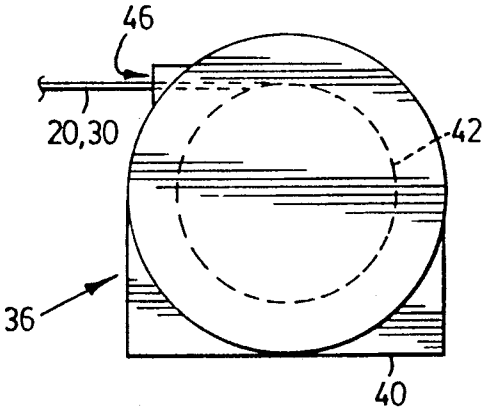
FIG. 7 is a schematic representation of a tension spring used in the embodiment of FIG. 6.

In the embodiment shown in FIGS. 1 to 5 a first anchor member or bracket 10 is mounted securely to the wall and a second anchor member or bracket 12 is shown mounted securely to the floor. In FIG. 5 suitable wood screw configurations are shown for mounting and the same is applicable to FIG. 4. In FIG. 1 although the second anchor bracket 12 is shown to be somewhat displaced to one side of the first anchor 10 for purposes of illustration, it is to be understood, that in a preferred configuration, the second anchor bracket 12 will be provided directly vertically beneath the first anchor bracket 10.

Figure 4:
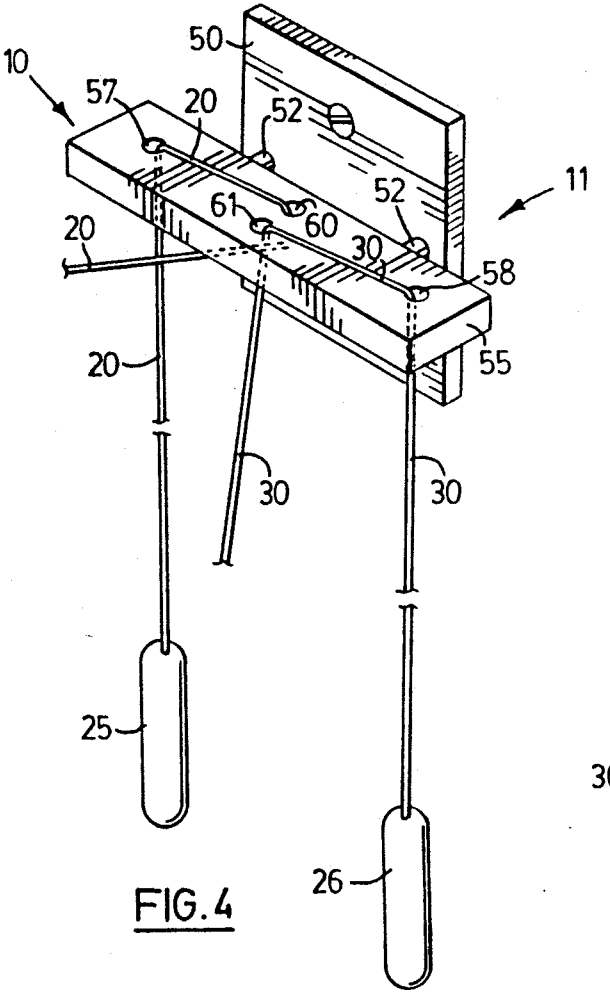
FIG. 4 is a perspective view of a first anchor bracket.

First anchor bracket 10, shown in FIG. 4, is attached to the wall by means of a plate 50. The plate is secured to the wall by any suitable means such as the wood screws used in connection with second anchor bracket 12. Extending outwardly from the plate 50 by means of extensions 51,52 is fairlead 55. The fairlead 55 has two holes 57,58 through which strings 20 and 30 are upwardly passed. Having passed over the shelf 55, the strings 20 and 30 are then downwardly threaded through two further fairleads 60,61 located one behind the other. In this configuration both strings, 20,30 from club 23 lie in the same vertical plane normal to the wall and this results in a smoother action of operation because the horizontal components of the forces are reduced as weight 26 begins its ascent. Holes 57,58, 60,61 are chamfered to allow smooth passage of strings 20,30.

The second anchor bracket 12 is provided with a hole 18 which, as shown in FIG. 5 is a chamfered hole passing through the bracket. It will be understood however that the fairlead could be provided by a channel, groove, pulley, or the like.

In the illustrated embodiment of FIGS. 1 to 5, a first biased string 20 is connected by means of a suitable loop 22 to the distal end 24 (the club head end) of a golf club 23. The string 20 passes through the holes 57,60 of the first bracket 10 and it changes direction. At the other end of the string 20 there is provided a suitable weight 25. The magnitude of the weight is selected for the particular exercise to be performed.

A second string 30 similarly connected by the loop 22 to the club head 24 interconnects with the second anchor bracket 12 and is entrained through the hole 18 thereof and upwardly to the third fairlead 11 integrally formed with anchor member 10, where it passes through its hole 58 and changes direction for a second time.

In order to limit the movement of the loop 22 on the club shaft, a suitable collar or collars (not shown) could be provided on the shaft. Alternatively a concave spool could be attached to the shaft so as to extend axially thereon. The spool would present a loop-receiving waist of diminished diameter and upper and lower outer ends of increased diameter, to prevent the loop from being pulled off the spool.

A weight 26, similar to the weight 25 on the first string 20 is provided at the end of the second tether string 30. The weights 25 and 26 may suitably be hollow cylindrical tubes which can be filled to different weights by some suitable elements such as lead shot. If desired, tubes or partitions could be provided on the wall to act as guideways for the weights.

If desired, a club having a telescopic handle could be used as an alternative to utilizing adjustable weights, so that weights 25 and 26 need not be adjustable according to the strength of the user.

In the configuration shown, the first string 20 provides a vertical component of a resistance force to motion and the second string 30 mainly provides the horizontal component of resistance. The strings 20 and 30 allow sufficient movement to duplicate the portion of the swing essential to strength and skill improvement. It will be obvious that the selection of the co-efficient of friction and the radius of curvature used in the holes of the fairlead can be a factor in the nature of the force applied to the ball striking device. The spacing of the brackets 10 and 12 can be selected according to the space available and when used indoors the bracket 10 is normally placed at a point near the ceiling of the room and the bracket 12 either on the floor, or on the wall at a distance normally not more than about 50 percent of the distance from the floor to the position of the bracket 10. The greater the vertical distance between brackets 10 and 12, the longer the appropriate resistance to the forces generated by the user is maintained when weights such as 25 are used and thus the longer the possible swing of the golf club 23.

Figure 2:
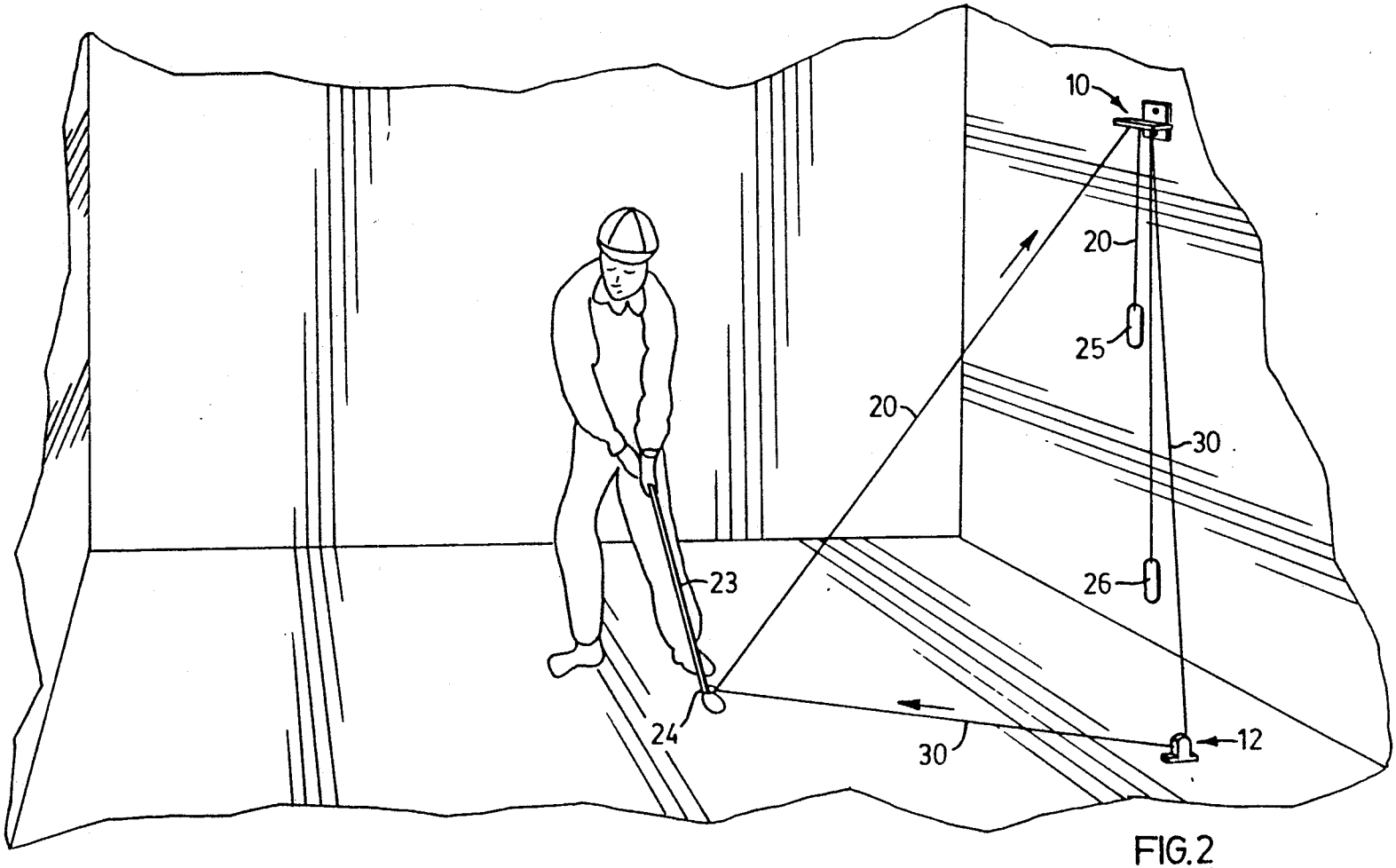
Figure 3:
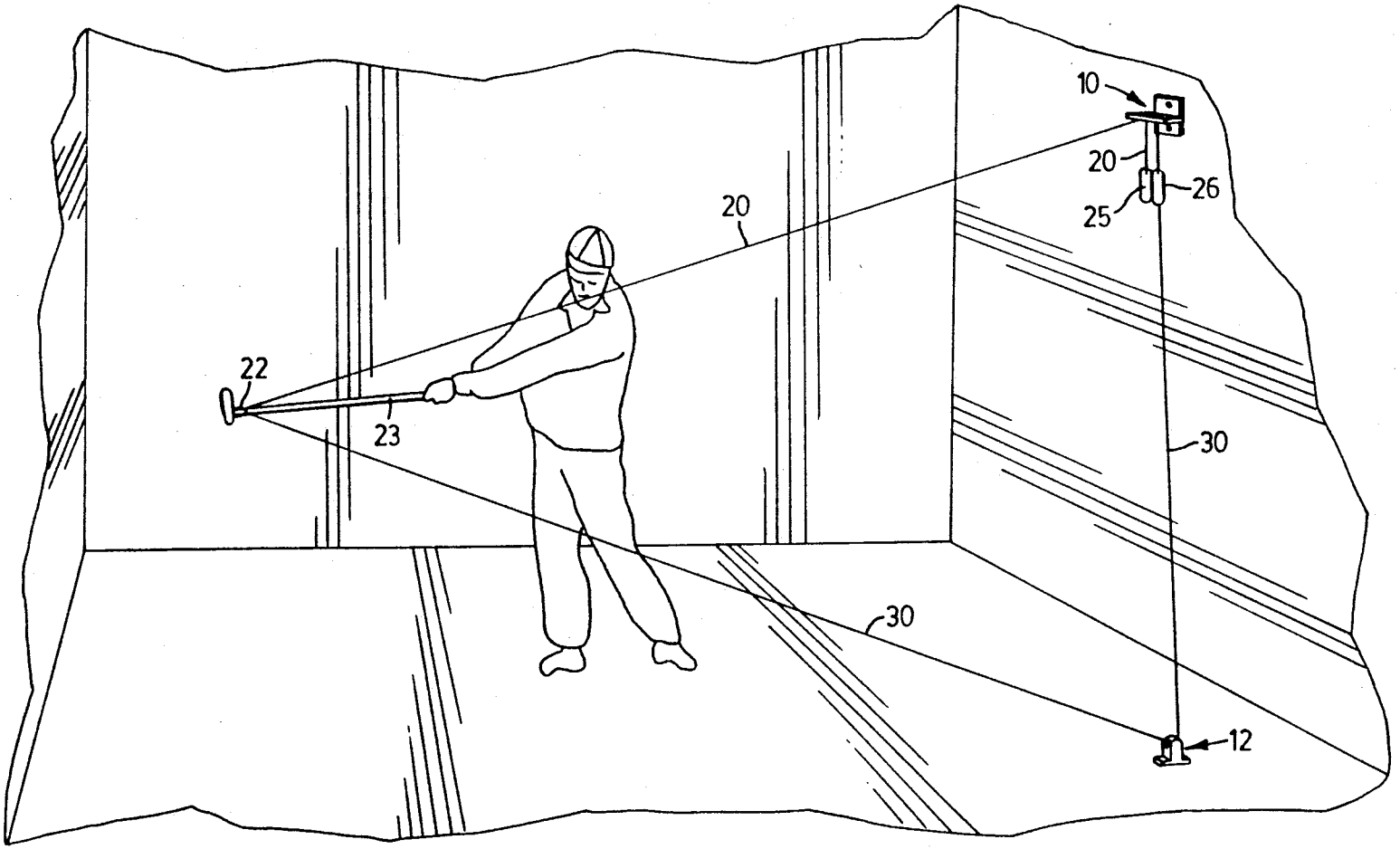

In an embodiment of the invention shown in FIGS. 1, 2 and 3, where the club head moves varying distances depending on the size of the club, and size and style of the user, the device gives benefit and may be used in only a portion of the swing, not including the part of the back-swing where the club head travels substantially horizontally over the head of the user. Since the portion of the swing used is the portion where maximum club head speed is desired, the correct use of the invention is of benefit. The club is swung from a point where the shaft is approximately vertical (FIG. 1) when in the golfer's stance, around to a point past the point at which impact with the ball (FIG. 2) is made, to the follow through (FIG. 3). Initially the string 20 from the attachment to the club through the bracket 10, pulls the weight 25 as the club descends and causes the weight 25 to rise, and simultaneously the string 30 allows the weight 26 to fall. As the club head moves through its arcuate path, the club head 24 begins to move less in a vertical direction and more in the horizontal direction, and tension forces begin to act on weight 26 and it begins to rise. In this particular configuration for a golf swing, the mass of weight 26 may be less than that of weight 25. Indeed weight 26 may be one tenth to two-thirds of the weight of 25. This means that the force resisting movement is the difference between weight 25 and weight 26, neglecting friction and the mass of the strings 20 and 30. As the club head 24 moves through the area of the normal placement of the ball, and continues into the "follow-through" both weights 25 and 26 are moving upward, creating resistance which is the sum of the weights, again neglecting friction and the weight of the strings. This increase of force builds strength and the ability to swing the club 27 so the club head 24 is accelerating through the ball and giving high club head speed. The exercise is best done at slow speed (no less than 3 seconds to complete the swing) so the user can focus on what is happening throughout the motion.

It will be understood that when used with other types of ball striking device such as a tennis racquet the strings 20 and 30 are similarly operationally severally connected by means of some tethering device such as the loop 22 to the center outer tip of the racquet, or a hook or a clip could be provided with means for preventing dislodgement.

When used for a swing of a type which is typical of forehand or backhand strokes in raquetball, tennis, and other racquet sports, the entire arc of the swing may be considered substantially horizontal. By approximately equalizing the weights 25 and 26, strength in these strokes can be gained by practicing them against the resistance of the weights. Since the equal weights generate approximately equal horizontal and vertical force components, the horizontal components add together to provide resistive force to the swing, while the vertical forces substantially cancel each other. Thus the racquet or the like can be swung horizontally at any height within the upper and lower placements of the brackets 10 and 12 and the user's muscles effectively strengthened.

Although the embodiment shown in FIGS. 1-5 show weights providing the biasing force for each of the strings 20 and 30, it will be understood that the weights could be replaced with springs attached at one end to the wall or floor and at the other end to the strings, or, a combination of springs and weights could be used.

Figure 6:
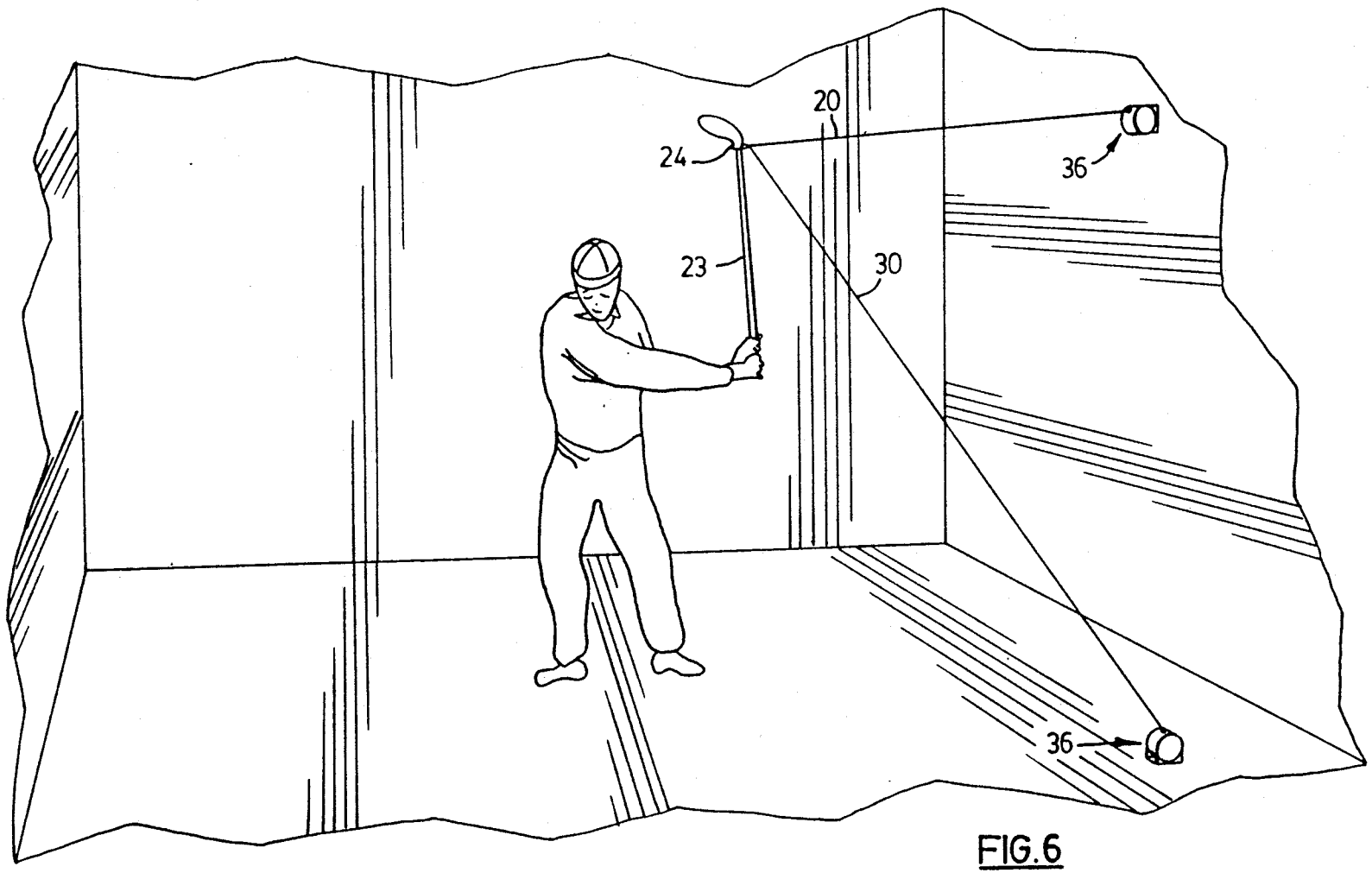
FIG. 6 is a pictorial illustration of the use of a further embodiment of the invention using anchor member provided with tension springs.

In FIG. 6, there is shown a pair of "clockwork" type spring devices 36 having a housing 40 anchored to the floor and the wall in the same manner as anchor members brackets 10,12 in the previous embodiment. The string 20 (or 30) is attached at its inner end to a clock-like spring 42 which may suitably be 16 to 20 feet long and generate an appropriate force of 1 to 10 pounds. As the string 20 (or 30) is pulled through an aperture 46 of the housing 40 by the action of the club swing, the string 20,30 pulls against the clockwork spring 42 which provides a biasing force. This force is initially set by the length and strength of spring 42 which is suitably made long enough so that the increase in force required as the line is pulled out increases only slightly over the full extension of the string 20,30 (deflection of the spring). A tensioning device, such as a ratchet and key arrangement (not shown), similar in principle to a clock spring and key arrangement, is added to increase the force applied by the spring to allow for adjustment in addition to adjustment of the club length (if the club has a telescopic shaft) to compensate for different user's strength.

Spring device 36 may alternatively be a constant force spring.

The spring 42 can be the same or different strengths, depending upon the application.

If used outdoors the device, of course, can be attached to the outside of a building, a tree, or other suitable point of attachment.

If desired for certain purposes, the brackets 10 and 12 could be provided with pulley block systems or other means of controlling the forces applied to the ball striking device during swinging.

It is also to be understood that the loop 22 is firmly anchored to the strings 20 and 23 and at the point where it encircles the shaft of the club 23, is held snugly against the shaft by some means such as a washer or elastic circlet. The inside of the loop may be treated or covered to raise its co-efficient to friction so that it will not change its position on the shaft or a collar may be placed on the shaft to prevent the loop from falling down the shaft, or some other suitable means.

Thus, it will be seen, any suitable biasing means of equal or different strengths can be used and different biasing means can be used for greater or lesser length of string travel, however the embodiment described with reference to FIGS. 1-6 is simple and versatile because, inter alia, the ease of varying the mass of the weights 25, 26, or club lengths, in the case of a club with a telescopic handle.

It will be appreciated that a further string could be attached to the club and to a surface opposite the surface to which the brackets 10 and 12 are mounted, to provide resistance for a swing which commences with the club shaft substantially horizontal above the user's head.

I claim:

1. An exercise apparatus for improving a user's swing with a ball striking device, comprising:

a) first and second anchor members mountable one higher than the other is spaced relation; and b) a first non-resilient, elongate flexible connector member attachable at one end thereof to a distal end of said ball striking device, said first elongate connector member operably coupled to said first anchor member and movable with respect thereto, and a second non-resilient, elongate flexible connector member attachable at a first end thereof to said distal end of said ball striking device, said second elongate connector member being operably coupled to said second anchor member and movable with respect thereto, the first and second connector members including bias means for biasing said first ends of said connector members towards said respective anchor members thereby applying, in use, predetermined restraining forces on said striking device vary as said ball striking device is swung.

2. An apparatus according to claim 1 wherein said first and second anchor members each comprise a housing, said housing including mounting means for mounting the housing to a supporting structure, the bias means being provided by a coil spring provided with a ratcheting device for tightening, said coil spring being mounted one in each of said housings, said operable coupling being effected by the end of said connector members opposed to said distal ends being attached each to a separate coil spring means so that as the connector member is unreeled from said clockwork spring said bias force is produced.

3. An apparatus according to claim 1 wherein said first and second anchor members each comprise fairlead means and mounting means attached to said fairlead means for mounting said fairlead means to a support member, the fairlead means suitable to entrain said connector members thereby forming said operable coupling.

4. An apparatus according to claim 3 wherein said first anchor member is adapted to be mounted above said second anchor member, said first anchor member fairlead means being suitable to entrain both connector members wherein that connector member which is entrained by the second anchor member extends upwardly to and is entrained by said first anchor member.

5. An apparatus according to claim 4 wherein the biasing means comprises a first weight connected to said first connector member and a second weight connected to the second connector member, the weights being attached to the respective connectors members at points thereon between the ends opposed to said distal ends and the portions of said connectors entrained by said first anchor means.

6. An apparatus according to claim 5 wherein said first and second weights are variable weights each comprising hollow members for receiving therein predetermined weights of shot.

7. An apparatus according to claim 6 wherein the first and second weights are unequal.

8. An apparatus as claimed in claim 1 in which said first and second anchor members are mountable one above the other substantially in vertical relationship.

* * * * *

UNITED STATES PATENT AND TRADEMARK OFFICE

CERTIFICATE OF CORRECTION

PATENT NO. : 5,158,299

DATED : October 27, 1992

INVENTOR(S) : Milton R. Otter

It is certified that error appears in the above-identified patent and that said Letters Patent is hereby corrected as shown below:

In the Claims

Claim 1, column 6, line 31, after the first instance of the word "device" insert --whilst it is moved in an arcuate path by the user, wherein said restraining forces on said ball striking device--

Claim 5, column 6, line 63, cancel "connectors" and insert --connector--

Signed and Sealed this

Twenty-sixth Day of October, 1993

Bruce Lehman

*Attest:*

BRUCE LEHMAN

*Attesting Officer*

*Commissioner of Patents and Trademarks*